US007296300B2

(12) United States Patent
Votolato

(10) Patent No.: US 7,296,300 B2
(45) Date of Patent: Nov. 20, 2007

(54) FINGER GUARD

(75) Inventor: Earl Votolato, Newport Beach, CA (US)

(73) Assignee: The Votolato Living Trust, Newport Beach, CA (US)

( * ) Notice: Subject to any disclaimer, the term of this patent is extended or adjusted under 35 U.S.C. 154(b) by 545 days.

(21) Appl. No.: 10/755,135

(22) Filed: Jan. 12, 2004

(65) Prior Publication Data

US 2005/0150029 A1 Jul. 14, 2005

(51) Int. Cl.
*A41D 13/08* (2006.01)

(52) U.S. Cl. ..... 2/21; 2/16

(58) Field of Classification Search ..... 2/21, 2/907, 16, 158, 163, 455, 20; 223/101; 441/58

See application file for complete search history.

(56) References Cited

U.S. PATENT DOCUMENTS

| | | | | | |
|---|---|---|---|---|---|
| 869,190 | A | * | 10/1907 | Matter | 441/58 |
| 1,062,587 | A | * | 5/1913 | Goersch | 441/58 |
| 1,066,696 | A | * | 7/1913 | Baker | 441/58 |
| 1,115,619 | A | * | 11/1914 | Tsukamoto | 30/298 |
| 1,184,710 | A | * | 5/1916 | Baumann | 83/860 |
| 1,455,826 | A | * | 5/1923 | Yorgnesen | 441/58 |
| 1,535,896 | A | * | 4/1925 | Bociek | 441/58 |
| 1,554,510 | A | * | 9/1925 | Kirby | 15/188 |
| 1,761,356 | A | | 6/1930 | McNamara | |
| 1,868,270 | A | * | 7/1932 | Bellman | 441/58 |
| 2,139,601 | A | * | 12/1938 | Piccardi | 441/57 |
| 2,149,922 | A | | 3/1939 | Lemire | |
| 2,159,972 | A | * | 5/1939 | Larson | 441/58 |
| 2,163,012 | A | | 6/1939 | Schenk | |
| 2,259,388 | A | | 10/1941 | Mell | |
| 2,389,196 | A | * | 11/1945 | Harmon | 441/58 |
| 2,501,571 | A | | 3/1950 | Liedtke | |
| 3,229,304 | A | * | 1/1966 | Brooks | 2/21 |
| 3,258,794 | A | * | 7/1966 | Goodwin et al. | 441/56 |
| 3,599,258 | A | * | 8/1971 | Murawski | 441/58 |
| D236,422 | S | | 8/1975 | Gayle | |
| 4,089,066 | A | | 5/1978 | Dethman | |
| D267,622 | S | | 1/1983 | Russell | |
| D275,360 | S | | 9/1984 | Child | |
| 4,507,804 | A | * | 4/1985 | Consigny | 2/21 |
| 4,665,561 | A | * | 5/1987 | Aoki | 2/19 |
| 4,704,742 | A | | 11/1987 | Foster | |
| 4,913,418 | A | * | 4/1990 | Schlueter et al. | 482/55 |
| 5,048,186 | A | | 9/1991 | Lamb et al. | |
| D335,196 | S | | 4/1993 | Lamb et al. | |
| D351,257 | S | * | 10/1994 | Roberts et al. | D29/113 |
| 5,429,535 | A | * | 7/1995 | Liese | 441/56 |

(Continued)

FOREIGN PATENT DOCUMENTS

| | | |
|---|---|---|
| FR | 2801090 | 11/1999 |

(Continued)

*Primary Examiner*—Alissa Hoey
*Assistant Examiner*—Jena Sold
(74) *Attorney, Agent, or Firm*—William W. Haefliger

(57) ABSTRACT

A finger guarding device, in combination a culinary finger guard plate, two finger guards upstanding from a side of the plate and having spacing therebetween to receive a user's middle finger to extend generally parallel to the plate, each finger guard having a finger retention portion overhanging the plate to provide adjustable spaces to receive the user's first and third fingers, between said overhang portion and the plate.

3 Claims, 2 Drawing Sheets

U.S. PATENT DOCUMENTS 5,450,626 A * 9/1995 Sorrels ..... 2/21
5,511,998 A * 4/1996 Johnson ..... 441/56
D381,129 S * 7/1997 Lawrence ..... D29/115
5,647,783 A * 7/1997 Nessel ..... 441/58
D385,666 S 10/1997 Abreu
5,711,027 A * 1/1998 Katz et al. ..... 2/21
D391,029 S * 2/1998 Katz et al. ..... D29/113
5,749,097 A * 5/1998 Garrett-Roe ..... 2/21
D414,300 S 9/1999 Silvey
D415,321 S 10/1999 Silvey
D418,258 S * 12/1999 Moro ..... D29/114
6,019,650 A * 2/2000 Rives et al. ..... 441/58
6,729,510 B1 * 5/2004 Romanov ..... 223/101
6,899,581 B1 * 5/2005 Nokes ..... 441/58
6,918,137 B2 * 7/2005 Fowler ..... 2/16

FOREIGN PATENT DOCUMENTS

FR 2801090 A1 * 5/2001

* cited by examiner

FINGER GUARD

BACKGROUND OF THE INVENTION

This invention relates generally to finger guards useful, for example, during culinary cutting and dicing of food; and more particularly the invention concerns improvements in such guards especially adapted to different size user fingers, while maintaining finger protection.

Prior finger guards were generally of circular loop shape, so as to be fixed in finger reception area. They were therefore clumsy to use, since user's have different size fingers. Also, prior guards did not readily accommodate to reception of three fingers of a user's hand, since loop shaped guards could not snugly or comfortably accommodate to the different cross sectional areas of first, second and middle fingers, of different user's hands, of different sizes.

SUMMARY OF THE INVENTION

It is a major object of the invention to provide a significantly improved finger guard device that overcomes the above problems and difficulties of prior devices.

Basically, the invention comprises:

a) a culinary finger guard plate, b) two finger guards upstanding from a side of the plate and having spacing therebetween to receive a user's middle finger to extend generally parallel to the plate, c) each finger guard having a finger retention portion overhanging the plate to provide adjustable spaces to receive the user's first and third fingers, between said overhang portion and the plate.

As will be seen, the finger retention portions have terminals spaced from the plate, whereby each guard is supported in cantilever relation to the plate, and has corresponding adjustability in size. Such guard cantilever support, at two locations, allows for adjustability of the space between the guards, to accommodate to snug reception of middle fingers of different sizes.

It is a further object of the invention to provide spaced finger guards, and a plate, of molded plastic material, the guards sufficiently thin to flex toward one another in response to first and third finger sideways pressure exertion.

Typically, the guards and plate are integrally molded, so that the guards can flex relatively toward one another to sidewardly grip the user's middle finger. As will be seen, each guard may have hook shape.

Yet another object is to provide a method of guarding the first, third and middle fingers of a culinary worker's hand, the method including the steps:

a) providing dual, spaced, guards with cantilever support at a base plate, b) inserting said middle finger into the space formed between the two guards, c) and also inserting said first and third fingers beneath said finger retention portions.

Another step comprises exerting sideward forces from said first and third fingers against guard portions at opposite sides of said spacing therebetween.

A further step includes providing each guard to have a terminal spaced from the plate, allowing the guard to flex during culinary use.

These and other objects and advantages of the invention, as well as the details of an illustrative embodiment, will be more fully understood from the following specification and drawings, in which:

DRAWING DESCRIPTION

DETAIL DESCRIPTION

Figure 1:
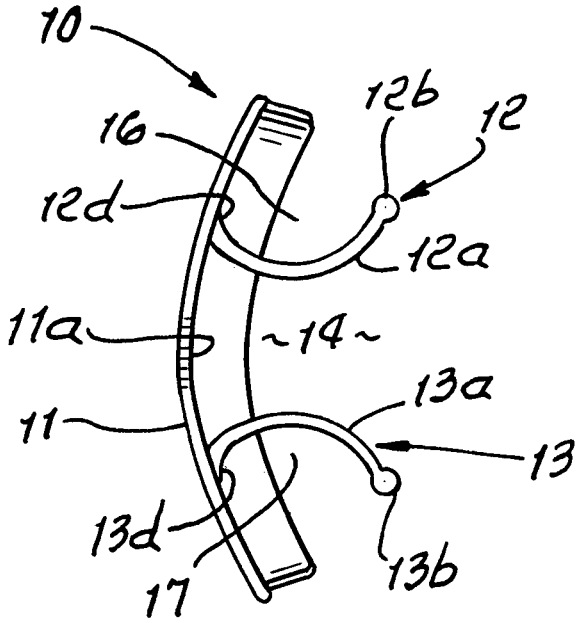
FIG. 1 is an end view of a device incorporating the invention.
Figure 2:
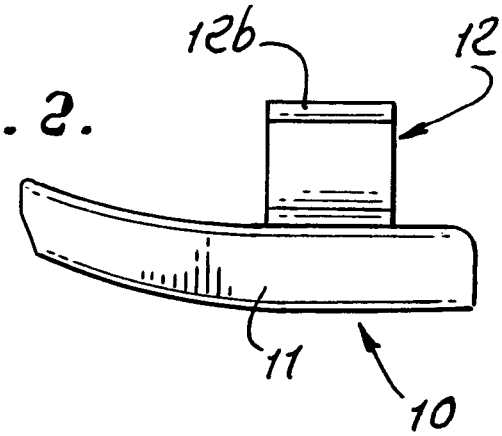
FIG. 2 is a side view of the FIG. 1 device.
Figure 3:
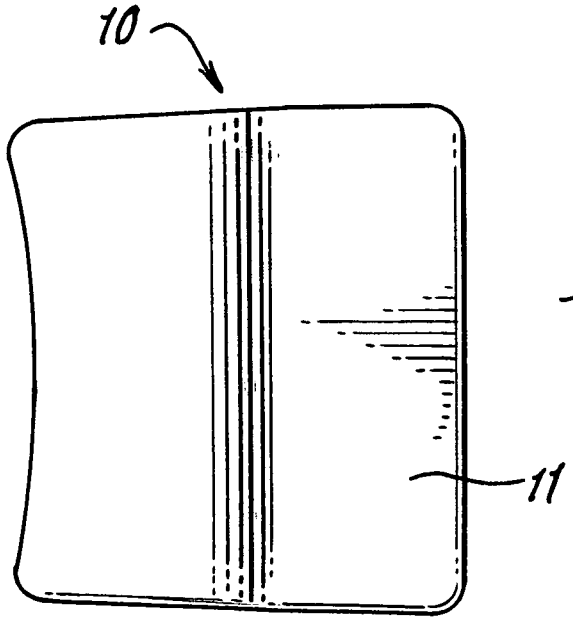
FIG. 3 is a bottom plan view of the FIG. 1 device.

As seen in the drawings, the preferred finger guarding device 10 includes a) a culinary finger guard plate 11, b) two finger guards 12 and 13 upstanding from a side 11*a* of the plate, and having intermediate spacing 14 therebetween to receive a user's middle finger 15 to extend adjacent to the plate, c) the finger guards have finger retention portions 12*a* and 13*a* overhanging the plate to provide for adjustable spaces 16 and 17 to receive the user's first and third fingers, between the overhang portions and the plate. As shown in the drawings, the overhanging portions project with curvature in opposite direction, and away from each other and with convexity toward said intermediate spacing whereby said intermediate spacing between the guards has venturi shape in a direction away from the plate.

As shown, the finger retention portions 12*a* and 13*a*, are arcuate, and have concave sides facing the plate, each guard having a terminal spaced from the plate, whereby the guard has cantilever support by the plate. See bulbous terminals 12*b* and 13*b*. See also the plate concave side 11*a* facing toward the finger guards. The guards have spaced, arcuate projecting portions defining said middle finger space 14 therebetween.

The plate and guards may consist of molded plastic material, and may be sufficiently thin to flex toward one another in response to first and third finger sideways pressure exertion, to adjust the sizes of the finger receiving spaces. Also, the plate and guards are typically integral, at locations of cantilever support of the guards. See such locations at 12*d* and 13*d*.

Accordingly, the two guards are configured to flex relatively toward one another to sidewardly grip the user's middle finger. Typically, each guard is a flat strip curved to define a hook shape.

In accordance with the invention, the method of guarding the first, third and middle fingers of a culinary worker, includes the steps, a) providing a device as described above, b) inserting the user's middle finger into the space formed between the two guards, c) and also inserting the first and third fingers into spaces 16 and 17 beneath the referenced finger retention portions, d) and using the device during culinary cutting of an object or objects, with the bi-directionally convex plate shielding the user's fingers from the cutting tool. See FIGS. 4 and 5. In this regard, the user's thumb and little finger remain free to grip and pick up objects.

Sideward force may be exerted from said first and third fingers against guard portions at opposite sides of the spacing therebetween, to adjust sizes of spaces 16 and 17.

Figure 4:
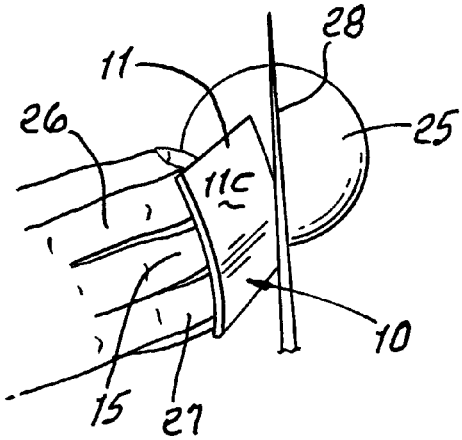
FIGS. 4-7 are views showing use of the device.
Figure 5:
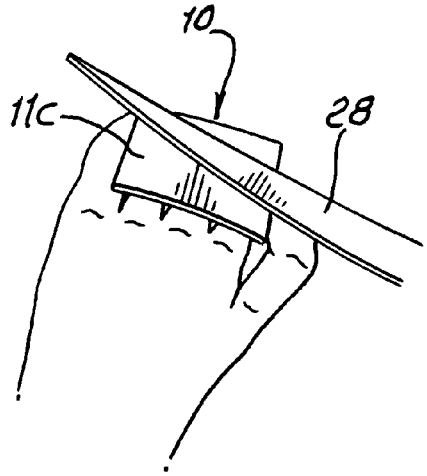
Figure 6:
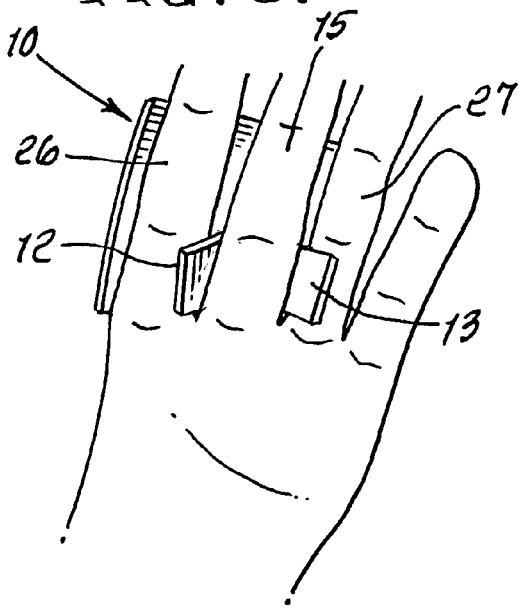
Figure 7:
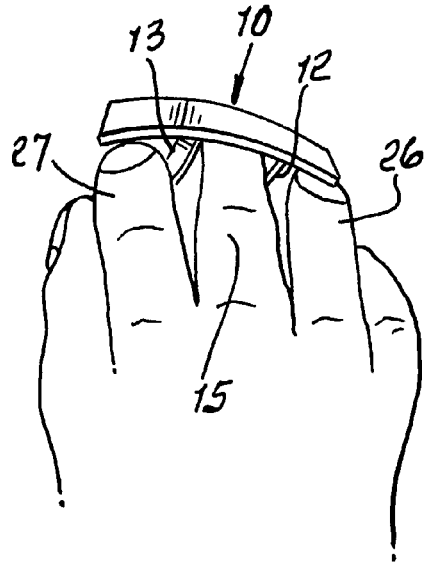

FIGS. 4-7 shows use of the devices, with the user's second, third and fourth fingers inserted in guarded position. FIGS. 4, 5 and 7 show the back side 11*c* of the plate 11, presented toward a knife 28. FIG. 4 shows cutting of apple 25. First and third fingers are shown at 26 and 27.

The plate and guards may consist of material other than plastic, as for example metal. The plate and guards may be formed separately, and subsequently connected together.

I claim:

1. The method of guarding the first, third and middle fingers of a culinary worker, that includes the steps a) providing a culinary finger guard plate, two finger guards upstanding from a side of the plate and having intermediate spacing therebetween to receive a user's middle finger to extend generally parallel to the plate, each finger guard having a finger retention portion overhanging the plate to provide adjustable spaces to receive the user's first and third fingers, between said overhanging portions and the plate, said overhanging portions projecting with curvatures in opposite directions, and away from each other and with convexity toward said intermediate spacing whereby said intermediate spacing between the guards has venturi shape in a direction away from the plate, b) inserting said middle finger into the venturi shaped space formed between the two guards, c) and also inserting said first and third fingers beneath said finger retention portions, d) and using said device during culinary cutting of an object with said plate shielding the user's fingers from the cutting tool.

2. The method of claim 1 including exerting sideward forces from said first and third fingers against guard portions at opposite sides of said spacing therebetween.

3. The method of claim 1 including providing each guard to have a terminal spaced from the plate, allowing the guard to flex during culinary use, said terminal having bulbous shape.

* * * * *